United States Patent [19]

Froment

[11] Patent Number: 4,474,219

[45] Date of Patent: Oct. 2, 1984

[54] SHED LOCATING DEVICES ASSOCIATED WITH DOBBIES AND OTHER WEAVING SYSTEMS

[75] Inventor: Jean-Paul Froment, Faverges, France

[73] Assignee: Societe des Etablissements Staubli (France), Faverges, France

[21] Appl. No.: 457,597

[22] Filed: Jan. 13, 1983

[30] Foreign Application Priority Data

Jan. 29, 1982 [FR] France ..... 82 01754

[51] Int. Cl.[3] ..... D03D 51/08

[52] U.S. Cl. ..... 139/1 E; 139/66 R; 139/336; 74/661

[58] Field of Search ..... 139/1 E, 1 R, 66 R, 139/336; 74/661; 192/18 A

[56] References Cited

U.S. PATENT DOCUMENTS

| | | | |
|---|---|---|---|
| 3,356,109 | 12/1967 | Neyraud | 139/1 E |
| 3,797,623 | 3/1974 | Gregorovich et al. | 74/661 X |
| 3,828,824 | 8/1974 | Macho | 139/1 E |
| 4,125,178 | 11/1978 | Monks | 74/661 |
| 4,244,399 | 1/1981 | Palau et al. | 139/1 E |

*Primary Examiner*—James Kee Chi

*Attorney, Agent, or Firm*—Dowell & Dowell

[57] ABSTRACT

The present invention relates to improvements in shed locating devices associated with dobbies and other weaving systems. A device is provided to enable the dobby shaft to remain coupled to the loom shaft whilst being connected to an auxiliary motor and gear reducer for providing low-speed drive of the loom and the dobby for use when working on the weaving system. The same motor and gear reducer are also used during shed locating operations. The mechanisms for shifting between the normal operation of the loom and dobby, the shed locating operation, and the low speed drive of the loom and dobby are electrically controlled.

4 Claims, 7 Drawing Figures

SHED LOCATING DEVICES ASSOCIATED WITH DOBBIES AND OTHER WEAVING SYSTEMS

The present invention relates to dobbies and other weaving systems and more particularly to the devices associated with the machines of this type with a view to automatically locating the shed.

In order to obtain perfect synchronism between the lifting of the heddle frames and the reciprocating displacement of the weft-passing member, the dobbies or other like mechanisms for forming the shed are known to be directly driven by a weaving loom itself. However, after the occurrence of a rupture of a weft yarn or to other weaving defect, it may be necessary to disconnect the dobby from the loom momentarily and to drive it in forward motion or in reverse motion at low speed, for one or more revolutions, so as to find synchronism again and allow the loom to operate correctly again. These momentary disconnection and slow drive operations are generally carried out automatically by a mechanism known as a "shed locating device".

Various arrangements have, in practice, been proposed for the devices of this type. In the majority of cases, the connection between the shaft driven by the loom and the shaft of the dobby is ensured by a dog mechanism which enables the two said shafts to be disconnected and makes it possible to engage the dobby shaft with the driven shaft of a gear reducer driven by an auxiliary electric motor.

The present invention relates to shed locating devices in which the dog mechanism is of the type such as described in Applicants' French Patent Application No. 78 16964 filed on May 31, 1978 which corresponds with U.S. Pat. No. 4,244,399. It will be seen that, in such a device, the dog mechanism comprises a sliding member angularly coupled to the shaft of the dobby and laterally provided with two opposite series of dog teeth adapted as a result of axial sliding of said member under the control of a rocking fork controlled by a cam driven in rotation by the auxiliary motor, to cooperate selectively with one or the other of two adjacent toothed plates. One of these plates rotates with the shaft of the weaving loom, the other with the driven shaft of the reducer associated with the afore-mentioned auxiliary motor. Therefore, as a function of the axial position of the sliding member, the shaft of the dobby is driven either by the loom, or by said auxiliary motor. Of course, electrical and mechanical means are advantageously provided during drive of the dobby by the auxiliary motor to stop automatically after every revolution of the shaft of the dobby during shed locating, so that such location is effected revolution by revolution in one or the other of the two directions of rotation of said shaft.

It has recently been noticed that, due to the presence of an electric motor with reducer, these shed locating devices might advantageously be used for driving, not just the dobby alone after disconnection of the shaft thereof from the shaft of the loom: but also, after actuating appropriate control means, the motor and reducer can be used to slowly drive the assembly formed by the dobby or other mechanism and the loom itself. This general drive, obviously at very slow speed, proves particularly useful for checking the working of the assembly and/or of each of the two elements constituting it, or with a view to precisely adjusting one or the other of said elements.

It is therefore an object of the improvements according to the present invention to provide the shed locating devices of the particular type mentioned hereinabove, with an arrangement adapted to allow the slow drive, when desired, of the dobby and of the loom by the motor of said reducer device.

To this end, the invention consists first of providing means for achieving angular connection between the sliding member of the dog mechanism and the wheel of the reducer mechanism driven by the auxiliary motor. This connection is achieved by a coupling adapted to be controlled independently of the sliding member itself so that the latter, whilst remaining in the axial position in which it effects connection between the shaft of the loom and the shaft of the dobby, remains connected to be driven by the auxiliary motor through the said coupling. Furthermore, the device is simultaneously provided with means serving to disable the action of the fork and prevent it from shifting the sliding dog member despite the working the the auxiliary motor, so that the low-speed drive of the loom and the dobby is not interrupted by movement attemped to be imparted to said fork by the cam connected to the auxiliary motor.

According to a preferred embodiment of the invention, the coupling mechanism and the disabling means are both electrically controlled so that they can be displaced with the aid of appropriate circuits against suitably arranged elastic return means.

The invention will be more readily understood on reading the following description with reference to the accompanying drawings, in which.

Figure 1:
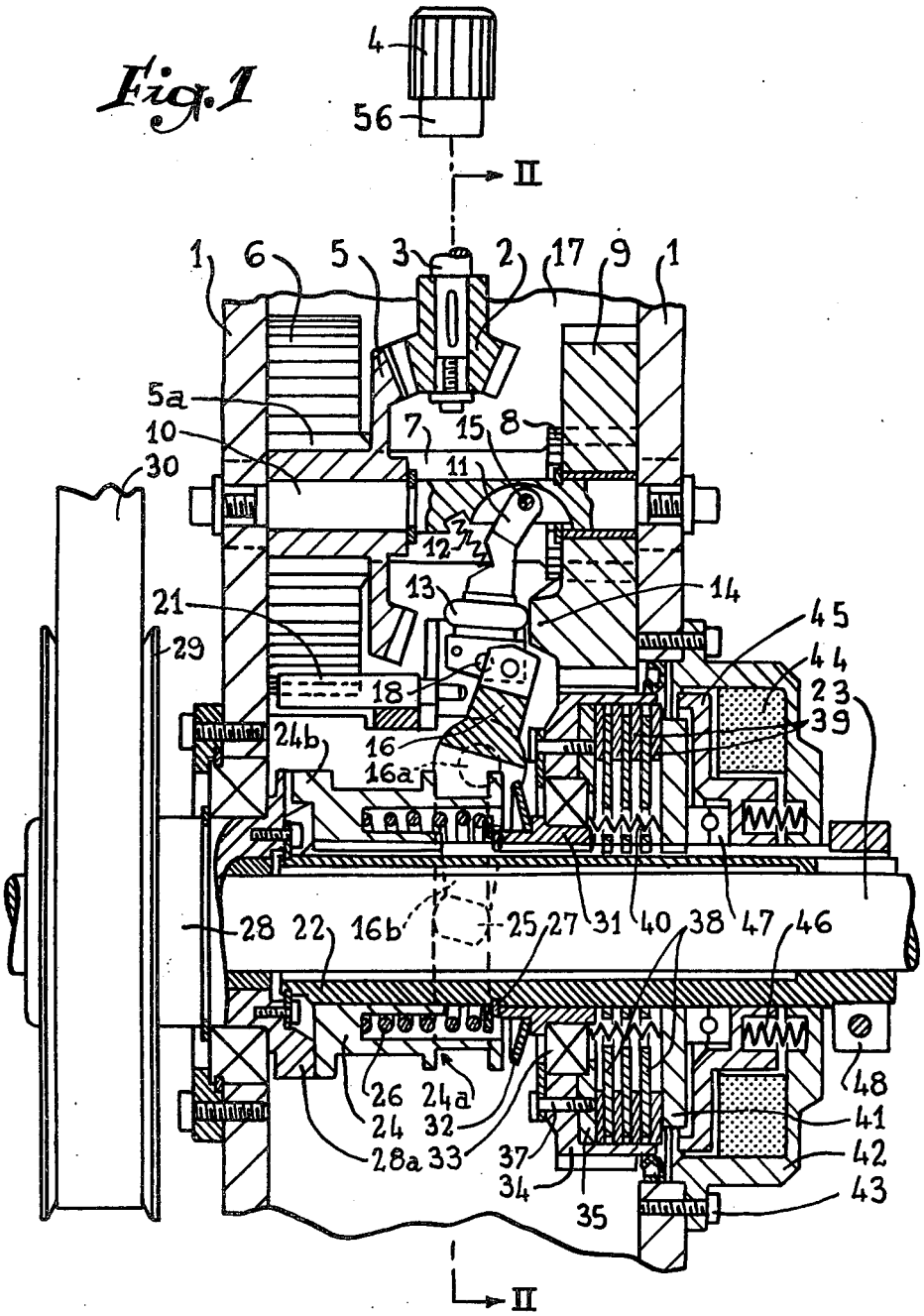
FIG. 1 is an axial section through a shed locating device according to the invention, the parts being shown in the position for which said device ensures drive of the loom-dobby assembly at low speed.
Figure 3:
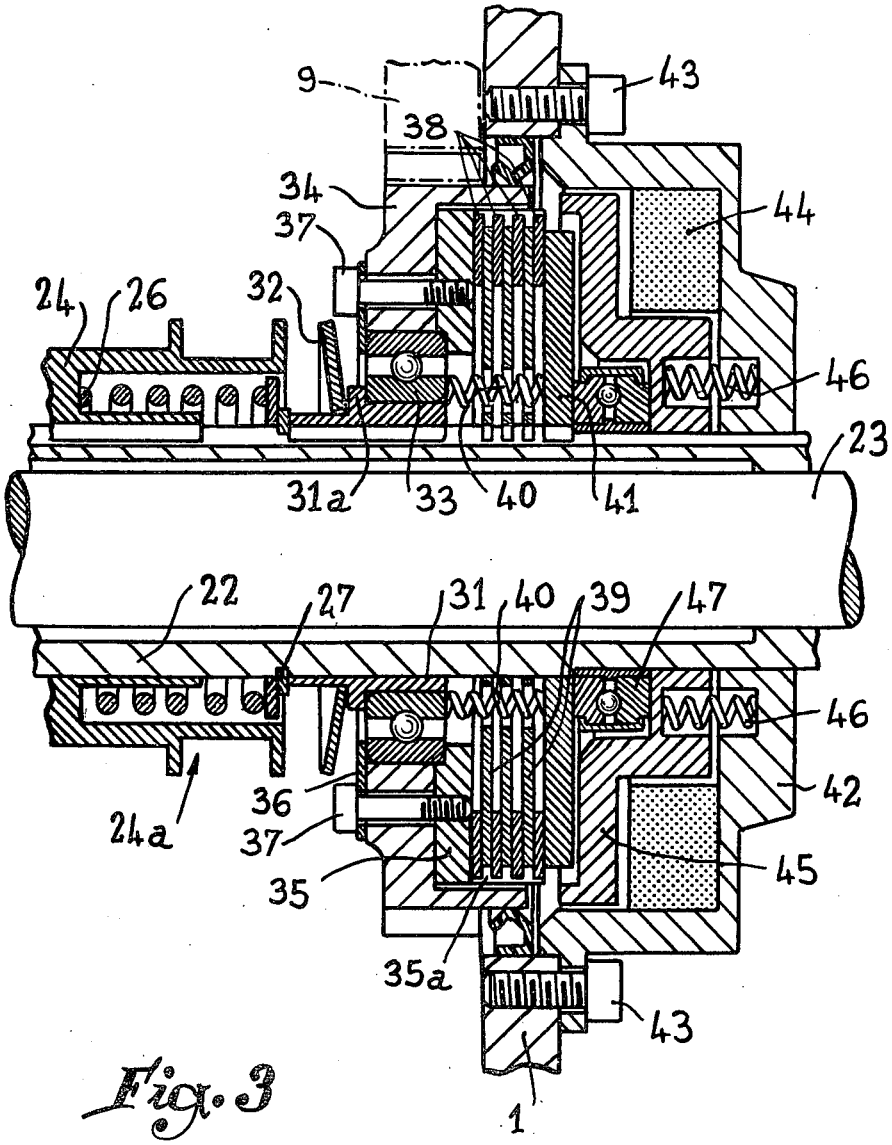

FIG. 3 reproduces part of FIG. 1 on an enlarged scale.

Figure 4:
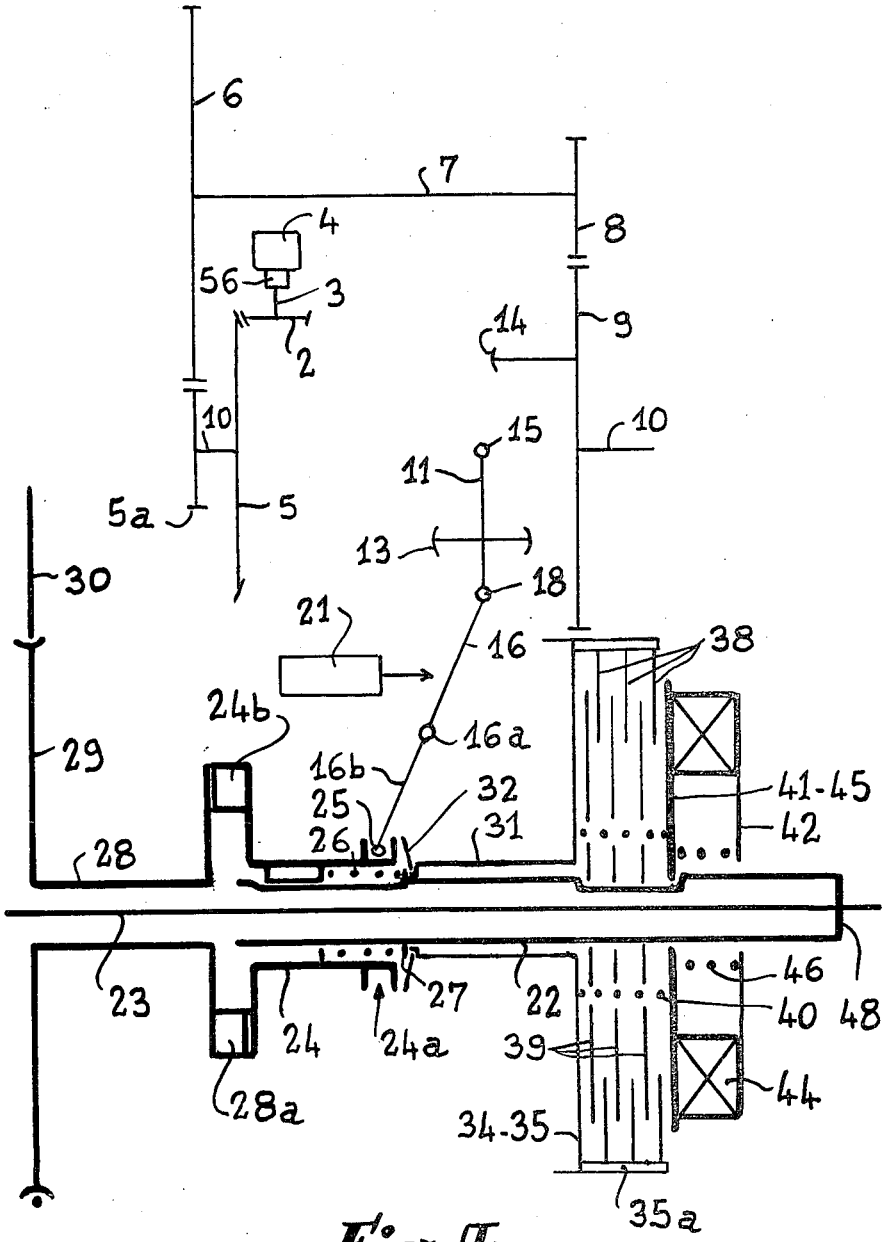
Figure 5:
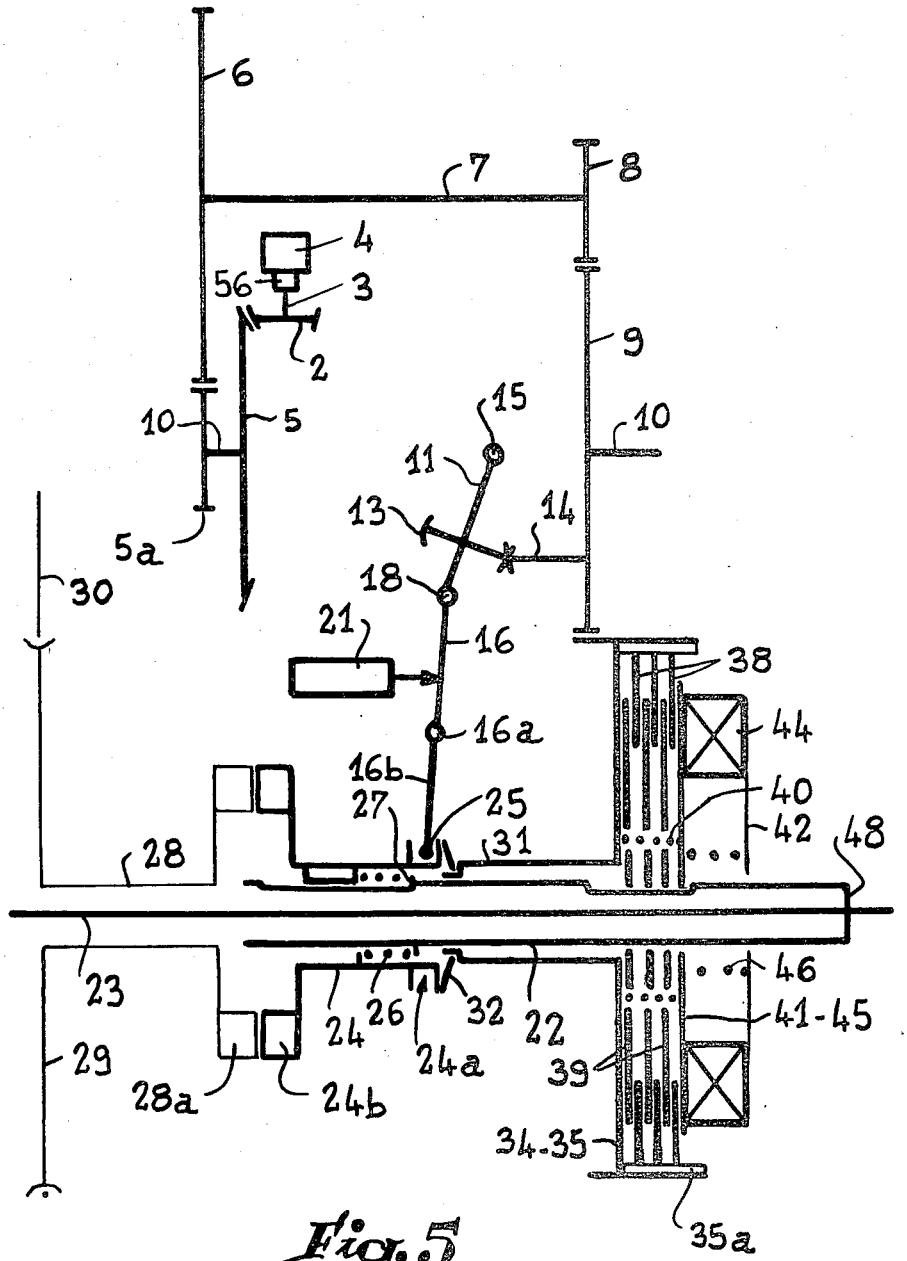
Figure 6:
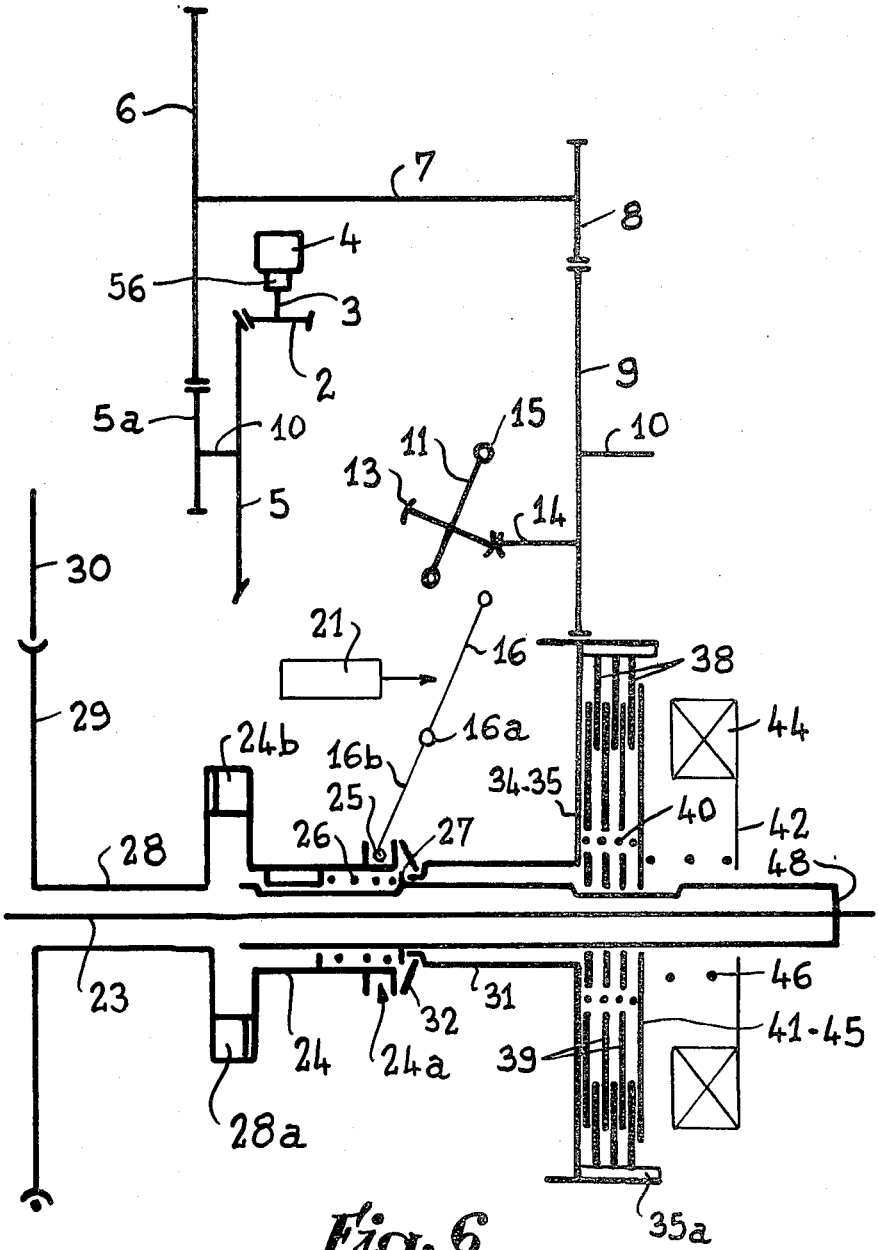

FIGS. 4, 5 and 6 are schematic drawings which illustrate the transmission of drive for the three main functions of the device, elements shown in heavy lines being active elements, and elements shown in lighter lines are inactive in the respective views.

Figure 7:
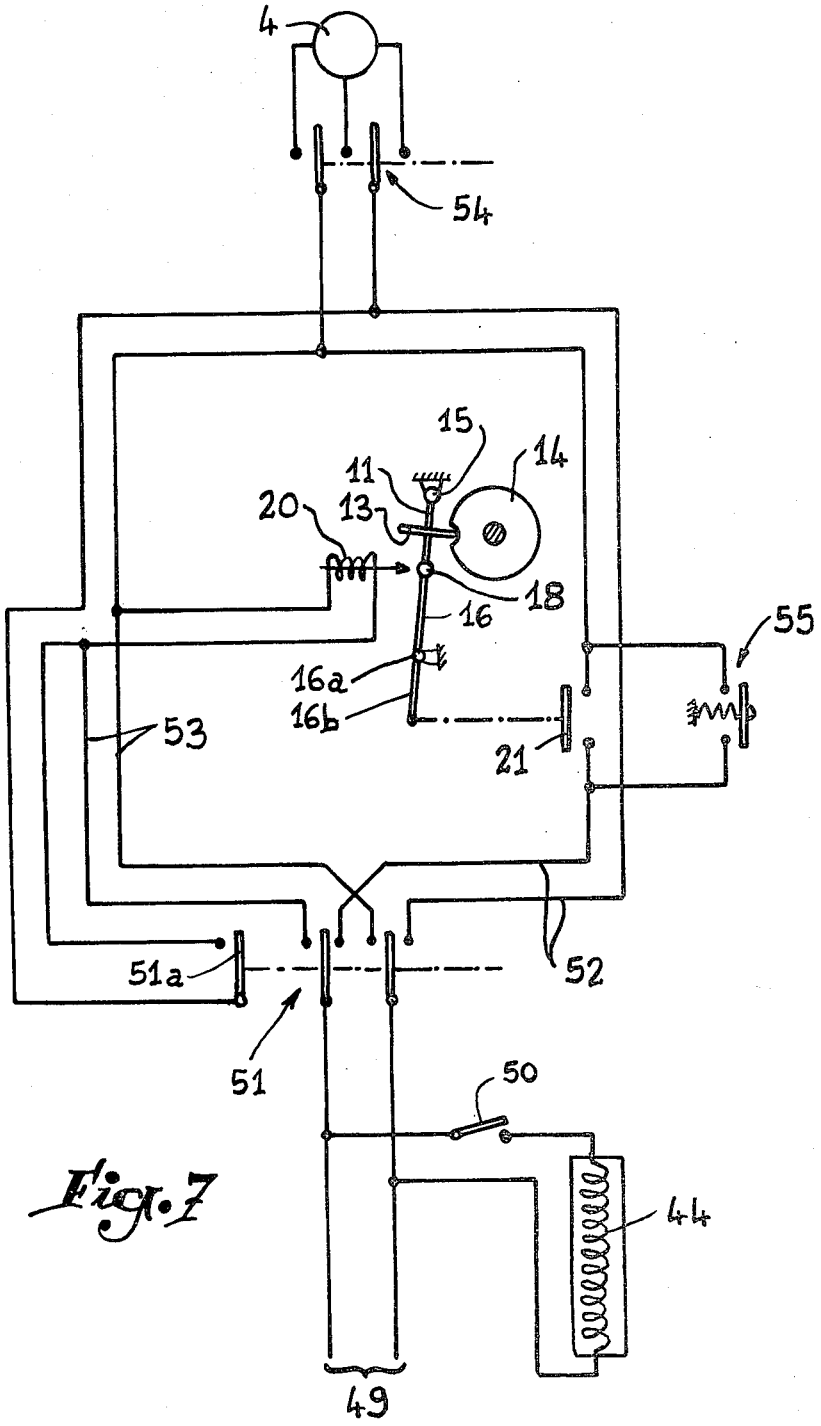

FIG. 7 shows the electrical diagram of this device in simplified form.

Referring now to the drawings, the whole of the device shown in FIG. 1 is mounted between two vertical side frame elements 1 assembled transversly with respect to each other by the shaft and pin of the reducer mechanism of said device. This reducer mechanism comprises a bevel pinion 2 fixed on the driven shaft 3 of an electric motor shown schematically at 4. The pinion 2 meshes with a toothed wheel 5 of which the hub is provided with a toothing 5*a* which meshes with a second wheel 6. This latter is fixed on a shaft 7 which bears at its opposite end a pinion 8 in mesh with a third wheel 9. It will be readily appreciated that a considerable gearing down is thus obtained of the movement furnished by motor 4.

Figure 2:
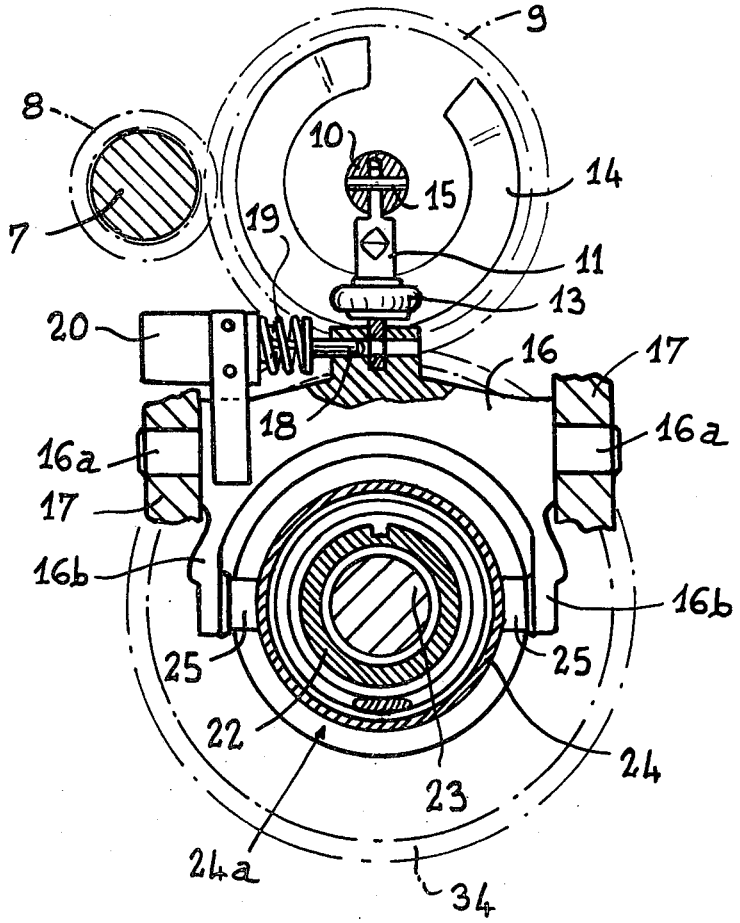
FIG. 2 is a vertical section along the plane schematically shown at II—II (FIG. 1).

A fixed pin 10 supports the wheels 5 and 9 and is notched to allow the articulated assembly of the upper end of a rocking lever 11 which is subjected to the action of a spring 12 so as to maintain an idle roller 13, borne by said lever, in contact with a cam 14 mounted on the lateral wall of the third wheel 9 of the reducer mechanism mentioned above. As shown more particularly in FIG. 2 (in which reference 15 denotes the upper pivot pin of lever 11), the lower end of this lever is coupled to the upper part of a fork 16 provided with two lateral bosses or pivots 16*a* which serve to provide articulated assembly thereof on two fixed frame end walls 17 which laterally close the space defined by the side frame elements 1.

Coupling of lever 11 and of fork 16 is effected with the aid of a horizontal pin or gudgeon 18 slidably introduced into holes disposed in alignment in the upper part of said fork and in the thinned lower end of the said lever. This pin 18 is urged by a spring 19 which tends to engage it in the afore-mentioned aligned holes. The gudgeon 18 is supported by the moveable core of an electromagnet 20 borne by the fork 16. Under these conditions, it will be readily appreciated that, when the electromagnet 20 is energized, the pin 18 retracts so that the fork 16 is then disconnected from lever 11, which may thus rock independently of said fork about its axis 15 whilst said fork remains independently articulated upon its bosses or pivots 16*a*.

It should be observed that, opposite the upper part of the fork 16, which is intended for axially controlling the sliding member of a dog mechanism described hereinafter, there is provided a push button switch 21 (FIG. 1) fixed against one of the side elements 1 and suitably connected to the electrical supply circuit of the motor 4, as will be seen hereinafter, FIG. 7. This push button switch 21 is disposed so that its mobile member is controlled for closure of said circuit when the fork 16, then connected to lever 11, rocks under the effect imparted to the latter by the action of the cam 14 on the roller 13.

The dog mechanism controlled by the fork 16 is borne by a sleeve 22 which is axially and angularly fixed, as will be seen hereinafter, with a shaft 23 which passes therethrough and which provides drive for the dobby. On the outer wall of the sleeve 22 is keyed a sliding ring member 24 which is thus driven in rotation with said sleeve 22 whilst being free to slide axially thereon. Such axial slide motion is controlled by said fork 16, of which each of the two arms 16*b* (FIG. 2) is provided with a pad 25 engaged in a groove 24*a* in ring member 24.

Inside the ring 24 is housed a spring 26 which, abutting against an annular stop 27 of the sleeve 22, tends to push said ring member towards the left in FIG. 1. The left-hand end of said ring member 24 flares out and bears a series of teeth 24*b* longitudinally oriented so as to engage under the effect of the spring 26 with the corresponding teeth of a lateral dog plate 28*a* fast with a tubular shaft 28. This shaft 28 rotates freely about the shaft 23 (so-called "dobby shaft") and its end which projects beyond corresponding side element 1 bears a pulley 29 which a belt or chain 30 connects to the weaving loom, so that this shaft 28 can be referred to as "loom shaft".

It will be readily appreciated that, when the teeth 24*b* are in mesh with the dog plate 28*a*, the shafts 23 and 28 are thus rendered angularly coupled with each other. In manner known per se, the teeth 24*b* of ring member 24 and those of dog plate 28*a* are arranged so that, once disconnected from one another, one of the two shafts 23 and 28 is obliged to make a complete revolution with respect to the other before said teeth can again engage with one another (so-called drive "revolution by revolution").

As shown in detail in FIG. 3, to the rear of the ring 24, the sleeve 22 slidably supports a bush 31 which is keyed thereto and which presents an annular shoulder 31*a*, which forms support on the one hand for an elastic washer 32 of conical type, on the other hand for a bearing 33. The latter is introduced into the axial opening of a toothed wheel 34 whose toothing meshes with the third toothed wheel 9 of the reducer mechanism. It should be observed that a ring 35 and a side element 36, connected to each other by screws such as 37, oblige the toothed wheel 34 to move axially with the bearing 33 and the bush 31.

The ring 35 which rotates with the wheel 34 is provided with spacer elements 35*a* oriented axially and arranged in the manner of a comb to retain a first series of sliding friction discs 38, spaced apart from one another to allow insertion of and interleaved second series of sliding friction discs 39, the assembly of the whole being similar to that of a coupling device incorporating multiple discs. The discs 39 are keyed on the sleeve 22 and are traversed by springs 40 which abut against the bearing 33 and against a second ring 41 keyed on the sleeve 22.

The toothed wheel 34 and the coupling device 38–39 are mounted in an opening made in one of the side elements 1, which opening receives a small dish-shaped cap 42 fixed in place with the aid of screws such as 43. In this cap 42 is housed a coil 44, arranged so that its supply of current ensures attraction of a plate 45 against springs 46. Between this plate 45 and the ring 41 mentioned above is interposed a stop supporting ball bearings 47, slidably borne by the sleeve 22.

It is on the axially slotted end of sleeve 22 which is disposed beyond the cap 42 that the clamp 48 is mounted (FIG. 1). This clamp compresses the slotted sleeve 22 against the shaft 23 to achieve angular and axial connection of said sleeve 22 and of the dobby shaft 23 on which it is mounted.

Before examining FIGS. 4 to 6 which show the working of the above-described device, the electrical diagram thereof, as illustrated in FIG. 7, should be analysed.

As shown, the coil 44 controlled through a switch 50 is connected across the general supply 49. This supply 49 terminates in a switch 51 adapted selectively to connected with said supply 49 one or the other of two circuits 52 and 53, which are connected to each other at a motor reversing switch 54 which controls motor 4 in one or the other of the two directions of rotation.

Between switches 51 and 54, the circuit 52 (which, as will be seen hereinafter corresponds to shed locating) is interrupted by the push button switch 21 associated with fork 16, it being noted that this push button switch 21 may be short-circuited by a second manually actuated push button 55. Between switches 51 and 54, the circuit 53, corresponding to general low-speed drive, supplies across it the electromagnet 20 associated with the retractable gudgeon 18 which ensures coupling of lever 11 and fork 16. The use of a separate contact 51*a* of switch 51 avoids any interference between the two circuits 52 and 53 downstream of the electromagnet 20.

Having explained this, reference will now be made to FIGS. 4, 5 and 6 wherein heavy lines show the parts which are in use and light lines show unused parts. FIG. 4 schematically illustrates the transmission of movement during normal working of the loom-dobby assembly. The spring 26 ensures meshing of teeth 24*b* and of plate 28*b* so that the movement of rotation of shaft 28 driven by the loom is transmitted by ring 24 to sleeve 22 and to the dobby shaft 23 which is driven in synchronism. The main switch 51 is in the neutral position shown in FIG. 7 so that the motor 4 receives no current. Moreover, the operator will have taken care to manoeuvre for closure of switch 50, so that the coil 44 is energized and attracts the plate 45 against the action of spring 46. The discs 38 and 39 are therefore not gripped against one another with the result that they do not transmit the movement to the assembly formed by the motor 4 and its reducer.

When, after the weaving loom has stopped, the operator wishes to locate the shed revolution by revolution, he moves the main switch 51 so as to supply circuit 52, switch 50 being maintained in closed position. After having selected using the reversing switch 54 the desired direction of drive (forward motion or reverse motion), he presses push button 55 so as to supply motor 4 momentarily, this supply being maintained through push button switch 21 once push button 55 has been released.

In fact, as illustrated in FIG. 5, the rotation of the shaft 3 of motor 4 has immediately caused rocking of lever 11 under the effect of the rotating cam 14. The pin 18 being located in coupling position, the mobile member of the push button switch 21 has been pushed because of the rocking of the fork 16. This latter has consequently caused sliding of the ring 24, and the axial displacement thereof towards the right against the spring 26 achieves disengagement of teeth 24*b* and of plate 28*a*. Shafts 28 and 23 are therefore disconnected.

In response to its electrical supply, the coil 44 continues to attract the plate 45 against the action of springs 46. However, on the other side of the plate by virtue of its displacement under the effect of the fork 16, the ring 24 has axially rightwardly pushed the sliding assembly formed by the washer 32, the bush 31, the bearing 33, the toothed wheel 34 (which is now being driven by wheel 9). Therefore the ring 35 is moved rightwardly and engages the discs 38 against discs 39. The rotation of shaft 3 of motor 4 is transmitted, with an appropriate reduction, to the dobby shaft 23 through the coupling device 38–39. This transmission is effected one revolution at a time since circuit 52 is opened by cam 14 releasing the push button switch 21 as soon as the teeth 24*b* have moved angularly through 360°, but a fresh rotation may be obtained by again depressing the push button 55 again.

When, for an adjustment or check, it is desired to use the shed locating device to ensure low-speed drive of the assembly formed by the loom and the dobby, the main switch 51 is actuated so as to supply the circuit 53 of FIG. 7. The switch 50 is opened whilst the motor reverser switch 54 has been used to select the desired direction of drive, as in the case of FIG. 5 corresponding to shed locating.

As illustrated in FIG. 6, the supply of motor 4 through circuit 53 has rendered the electromagnet 20 live, so that the pin 18 has retracted and fork 16 is disconnected from lever 11. Under these conditions, the angular displacement of lever 11 under the effect of cam 14 no longer has any influence on the fork 16. Therefore, the spring 26 and the washer 32 to push the ring 24 leftwardly which then effects meshing of teeth 24*b* and plate 28*a*, so that the shafts 23 and 28 are again angularly connected to each other through the sleeve 22.

Furthermore, the springs 46 have pushed axially towards the left the plate 45 (released by the coil 44 which is no longer supplied), the stop 47 and the ring 41, so that the discs 38 and 39 are engaged and gripped against one another. The movement of rotation of shaft 3 of motor 4 is consequently transmitted through the reducer to the two shafts 23 and 28 which are driven at low speed. This drive is not limited revolution by revolution since the push button 21 is disabled. Therefore the drive only stops when the operator opens the main switch 51. It will be noted that as soon as the device has been returned to the position corresponding to shed locating FIG. 5, the lever 11 will be returned to the position for which the pin 18, urged by its return spring 19, is in alignment with respect to the hole in said lever and will consequently achieve coupling of said lever and of fork 16 again.

It is interesting to note that, in the event of accidental cut-off of the supply 49, the shed locating device according to the invention guarantees automatic, instantaneous blocking of the dobby. In fact, if the mechanism is in position of FIG. 4 corresponding to the drive of the dobby by the loom in normal operation, cut-off of the supply of coil 44 enables the springs 46 to grip the discs 38 and 39, so that the two shafts 23 and 28, which remain connected to each other by mesh of teeth 24*a* and plate 28*a*, are immobilized by the reducer mechanism (most often of the irreversible type) and/or by a brake 56, operating automatically by lack of current, advantageously associated with motor 4.

If the mechanism is in the position of FIG. 6 (drive of the loom-dobby assembly at low speed), the situation is identical since the two shafts 23 and 28, which are connected to each other, are also at the moment of cut-off of current angularly connected to the irreversible reducer and/or to the motor 4 equipped with its brake 56.

Finally, if the mechanism is in the position illustrated in FIG. 5 (shed locating), the dobby shaft 23 is immobilized angularly by the reducer mechanism and/or the brake 56, any possible rotation of the loom shaft 28, which is not retained, being without practical importance at that moment.

This automatic immobilization of the dobby in the event of breakdown in the general electrical supply is very useful since it radically opposes any untimely movement of the members of the dobby under the effect of the weight of the heddle frames associated therewith.

It will be further understood that the electrical control members 50, 51, 55 and 54 are advantageously grouped together on a common console. It goes without saying that the switch 50 is preferably arranged to be automatically actuated for closure when the main switch is taken to the position for which it supplies the circuit 52.

It must, moreover, be understood that the foregoing description has been given only by way of example and that it in no way limits the domain of the invention; replacement of the details of execution by any other equivalents would not depart from the scope thereof. In particular, the coil 44 may be replaced by a jack or other pneumatically or hydraulically actuated thrust mechanism whose control circuit depends on an electrical member similar to switch 50. A coupling mechanism different from the one incorporating multiple discs 38–39 which has been illustrated hereinabove, may also be envisaged.

What is claimed is:

1. A shed locating device to be interposed between a drive shaft of a weaving loom and a dobby shaft, comprising:

(a) a frame supporting said shafts in mutual alignment;

(b) a reversible auxiliary drive motor on said frame and connected to drive a gear reducer terminating in a low speed gear wheel having a cam mounted thereon;

(c) a dog plate fixed to the loom shaft; and a complementary dog ring axially slidably carried on and keyed to the dobby shaft and operative in a first axial position to engage the dog plate whereby to connect said shafts, and in a second axial position to disconnect said shafts;

(d) a rocking lever supported in the frame adjacent to the cam; a rocking control fork supported in the frame and engaging the dog ring to move the latter to one of said two positions; and retractable gudgeon means normally connecting the lever and fork, the lever being engaged by the cam when the auxiliary motor drives the gear wheel to shift the fork to disengage the dog ring from the dog plate during each revolution of the gear wheel;

(e) a first coupling device supported on the dobby shaft and actuated by said dog ring when in said disconnected second position to couple said low speed gear wheel to the dobby shaft to rotate it with drive from the reversible auxiliary motor; and (f) a second coupling device selectively operable when the dog ring is in the first engaged position for coupling the reducer gear wheel to drive the dobby shaft and the loom shaft which is connected to it.

2. In a shed locating device as claimed in claim 1, said coupling device including interleaved friction discs carried respectively by said dobby shaft and by a toothed wheel meshing with said gear wheel, said first coupling device including means for pressing the discs together when the toothed wheel is engaged by the dog ring in its disconnected second position, and said second coupling device including means operable when the dog ring is in its connected first position for pressing the discs together.

3. In a shed locating device as claimed in claim 1, control means having means selectively operable in one position for engaging said gudgeon means to connect the lever and the fork and for energizing the auxiliary motor to drive only the dobby shaft; and the control means having means selectively operable in a different position to retract the gudgeon means to disconnect the lever and fork to leave the dog ring and dog plate connected, and to operate the second coupling means and auxiliary motor to drive the dobby shaft and the loom shaft.

4. In a shed locating device as claimed in claim 3, said gudgeon means being spring urged normally to connect the fork and lever, and said dog ring being spring urged normally to connect with the dog plate to couple the shafts; said control means further comprising electrically actuated means for retracting the gudgeon means, electrically actuated means for operating said second coupling means, and switch means for controlling said electically actuated means and the auxiliary motor.

* * * * *